US005176225A

United States Patent [19]

Nussbaum

[11] Patent Number: 5,176,225

[45] Date of Patent: Jan. 5, 1993

[54] LIFTING PLATFORM FOR MOTOR VEHICLES

[75] Inventor: Hans Nussbaum, Kehl-Sundheim, Fed. Rep. of Germany

[73] Assignee: Otto Nussbaum GmbH & Co. KG, Fed. Rep. of Germany

[21] Appl. No.: 755,172

[22] Filed: Sep. 5, 1991

[30] Foreign Application Priority Data

Sep. 7, 1990 [DE] Fed. Rep. of Germany ..... 4028484

[51] Int. Cl.[5] ..... B66F 7/00

[52] U.S. Cl. ..... 187/8.43; 187/8.54

[58] Field of Search ..... 187/8.41, 8.43, 8.47, 187/8.54, 26

[56] References Cited

U.S. PATENT DOCUMENTS

| | | | |
|---|---|---|---|
| 2,593,630 | 4/1952 | Thompson | 187/8.41 X |
| 3,275,170 | 9/1966 | MacRae et al. | 187/26 X |
| 3,279,562 | 10/1966 | Farrell | 187/8.41 |
| 4,545,462 | 10/1985 | Sul | 187/8.41 |
| 4,763,761 | 8/1988 | McKinsey et al. | 187/8.41 |

FOREIGN PATENT DOCUMENTS

| | | |
|---|---|---|
| 1195028 | 6/1965 | Fed. Rep. of Germany . |
| 2011084 | 9/1971 | Fed. Rep. of Germany . |
| 8807373 | 9/1988 | Fed. Rep. of Germany . |
| 9104973 | 7/1991 | Fed. Rep. of Germany . |
| 705394 | 5/1966 | Italy . |
| 52-31442 | 9/1977 | Japan . |

*Primary Examiner*—Robert P. Olszewski
*Assistant Examiner*—Dean A. Reichard
*Attorney, Agent, or Firm*—Marshall, O'Toole, Gerstein, Murray & Bicknell

[57] ABSTRACT

A lifting platform for motor vehicles having two vertically movable columns in which additional lifting elements are disposed is disclosed. The lifting elements are connected to a common drive means via traction means and guide rollers in such a way that the two lifting elements can be driven synchronously with a single drive means.

12 Claims, 1 Drawing Sheet

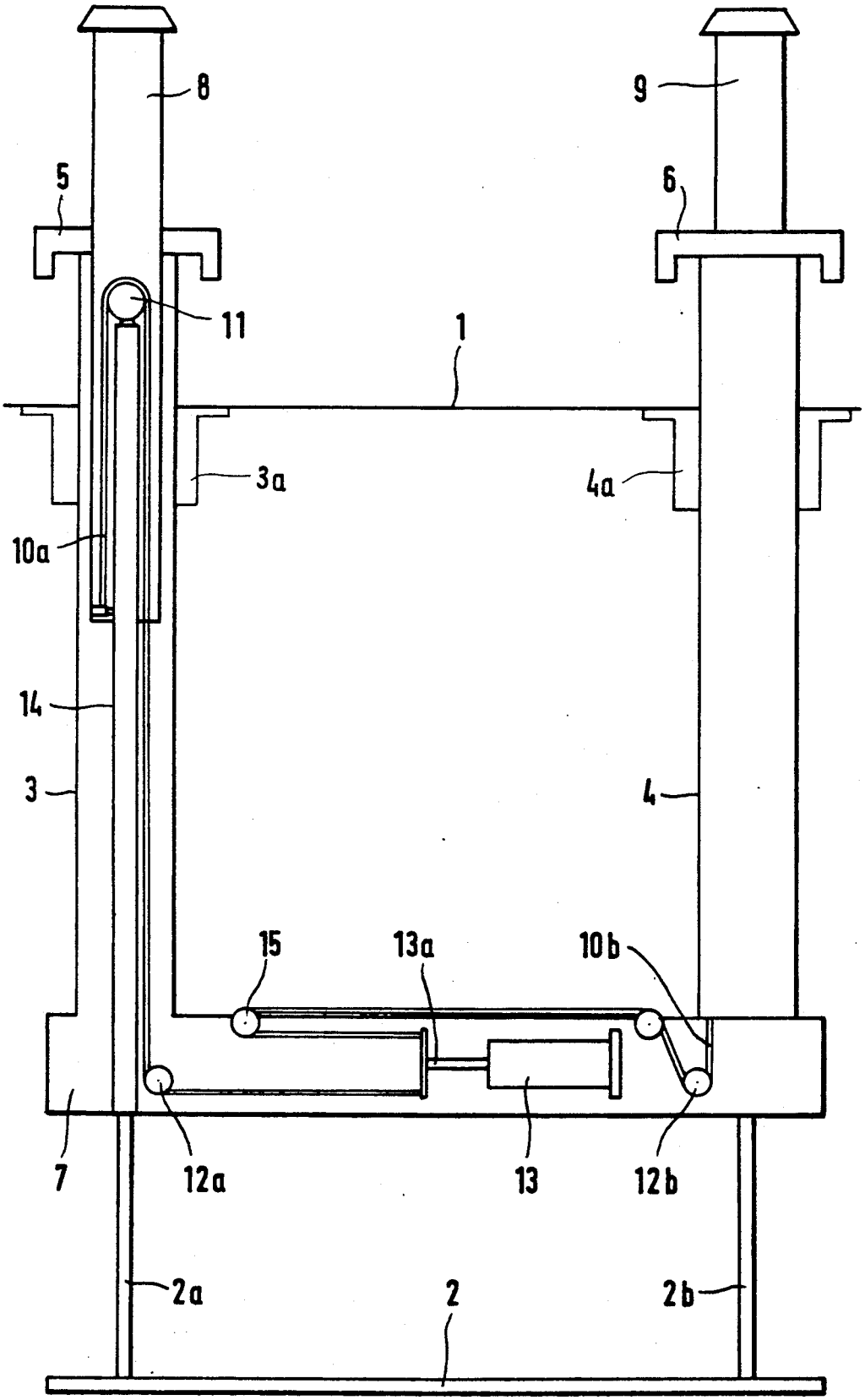
8
9
5
6
11
1
3a
4a
10a
14
3
4
15
13a
10b
7
12a
13
12b
2a
2
2b

LIFTING PLATFORM FOR MOTOR VEHICLES

BACKGROUND OF THE INVENTION

The invention relates to a lifting platform for motor vehicles, especially for passenger cars, of the type having at least two vertically movable columns, with at least one supporting surface at the upper ends of the columns for the wheels of the vehicle. The supporting surfaces are generally in the form of rails on which the vehicle wheels may travel. Additional lifting elements, preferably disposed on, and highly preferably disposed within the columns, are provided for free-lifting of the wheels of the vehicle.

Such lifting platforms have the advantage that the vehicle can be lifted from the supporting surfaces so that repair of the brakes or examination of the axles, for example, can be carried out at a convenient working height.

In such lifting platforms of the prior art, the elements for free-lifting the wheels are typically driven by two hydraulic cylinders which are disposed inside respective columns. In order for the lifting elements to operate synchronously, it is necessary to provide a connection between them. Rack synchronization is generally used for this purpose.

SUMMARY OF THE INVENTION

According to the invention, a lifting platform of the type described above is improved in such a way that it can be produced at a lower cost while it fulfills qualitatively all the requirements of its intended purpose.

According to the invention, the lifting elements have a common drive means that is connected to both lifting elements via traction means.

In this way, only one means for driving the two lifting elements is required, and the rack synchronization which was necessary in the past can be eliminated.

The drive means preferably acts in the substantially horizontal direction and is mounted on a transverse yoke that connects the two columns near their respective lower ends. This transverse yoke is necessary for synchronization in any case and essentially provides more space to accommodate the drive means than the inside of the columns into which in the past have accommodated the two hydraulic cylinders. The connection of the drive means to the two lifting elements is done with the aid of traction means, preferably in the form of chains or cords which extend to the lifting elements over guide rollers or other means which change the directions of the traction means.

The type of drive means may be selected from various possibilities, including two-sided spindle and piston drives. Alternatively, drive means which operate only on one side may be used and, in such cases, the required opposite working of two traction means may be effected by subjecting one of the traction means to an additional 180° deflection. For example, one can use a simple hydraulic cylinder-piston combination as a drive means.

DETAILED DESCRIPTION OF THE INVENTION

Other characteristics and advantages of the invention will be apparent from the following description of an embodiment of the invention, with reference to the sole figure which is a schematic representation, partially in vertical cross-section, of an inventive lifting platform.

A ditch or other open space is disposed under a floor 1 of a workroom with a supporting frame 2 of the lifting platform resting on the foundation thereof. Piston rods 2*a* and 2*b* are fixed to and extend upwardly from the frame 2. Two driven columns 3 and 4 are mounted for vertical movement along the frame 2. The columns may be guided by guide sleeves 3*a* and 4*a*, respectively, which are secured to the floor 1 about the columns 3 and 4, as shown. Preferably, the columns 3 and 4 are driven hydraulically or, alternatively, by spindles, as is known in the art.

At their upper ends, the columns 3 and 4 each have a guide rail 5 or 6, respectively. When the lifting platform is in its lowered position, the guide rails 5 and 6 can be flush with the workroom floor 1 or, when the guide sleeves 3*a* and 4*a* are disposed at floor level, as shown in the figure, the guide rails 5 and 6 each have a small ramp (not shown) at their respective ends, where the vehicle is driven on to the rails.

At their lower ends, the columns 3 and 4 are connected through a transverse yoke 7 which ensures that the columns rise or are lowered absolutely synchronously.

Lifting pistons 8 and 9 are disposed within the columns 3 and 4, respectively, and are movable in the vertical direction, so that a vehicle standing on the guide rails 5 and 6 can be lifted off its wheels. Because pistons 8 and 9 are actuated separately from columns 3 and 4, in the case of repair work at the wheels, brakes or axles, lifting pistons 8 and 9 are therefore able to telescope out of columns 3 and 4, allowing access to the parts that need repair.

As shown, the lifting cylinders 8 and 9 are each connected at their respective lower ends to traction means 10*a* and 10*b*, respectively, which extend vertically upwardly and then are deflected downwardly through a guide roller 11 (shown in column 3 only) by 180°, then deflected horizontally through other guide rollers 12*a* and 12*b*, respectively, and finally are secured to a horizontally acting drive means 13 mounted on or within the transverse yoke 7.

In this connection, the upper guide rollers 11 are secured directly or indirectly on columns 3 and 4, so that they follow the vertical movement thereof. In the illustrated embodiment they are secured on a lifting cylinder 14 which is hydraulically movable vertically with respect to the piston rods 2*a* and 2*b* which are fixed to the frame 2.

The lower guide rollers 12*a* and 12*b* are mounted on the transverse yoke 7, similarly to the drive means 13.

Since the drive means 13 in the exemplary embodiment is designed as a cylinder-piston combination acting on one side, one of the traction means 10*b* is directed around another guide roller 15, so that the traction means 10*b* is deflected by 180° horizontally and will extend in the same direction as the traction means 10*a* of the controlling piston 13*a* of the drive means 13. As a result of this, when the piston 13*a* moves in a given direction, the respective movements of the traction means 10*a* and 10*b* will be in horizontally opposite directions and, as a result, the cylinders 8 and 9 will perform the identical vertical lifting movement.

Thus, a single drive means for both lifting cylinders 8 and 9 may be used without additional means for synchronizing movement of the two lifting cylinders 8 and 9. Also, the space available on or within the transverse yoke 7 is utilized optimally. The preferred positioning of drive means 13 in the area of the transverse yoke 7 according to the invention does not intrude into the area of the rails 5 and 6, so that the work that is to be carried out on the vehicle will not be hindered in any way.

The foregoing detailed description is given for clearness of understanding only, and no unnecessary limitations should be understood therefrom, as modifications within the scope of the invention will be apparent to those skilled in the art.

I claim:

1. A lifting platform for a motor vehicle comprising at least two vertically movable columns (3,4) having at least one supporting area (5,6) for receiving the wheels of the vehicle, wherein lifting elements (8,9) are disposed on each respective column (3,4), characterized in that the lifting elements (8,9) have a common drive means (13) connected thereto via traction means (**1-*a*,10*b*) and are vertically movable separately from said movable columns (3,4**).

2. A lifting platform according to claim 1 wherein said drive means (13) acts in substantially the horizontal direction and said traction means (**10*a*, 10*b*) are operatively connected to the lifting elements (8,9) through guide rollers (11,12*a*,12*b***).

3. A lifting platform according to claim 2 wherein said drive means (13) acts only on one side thereof and said traction means (**10*b*) connected to one of said lifting elements (9) undergoes a 180° deflection through a guide roller (15**).

4. A lifting platform according to claim 1 wherein said drive means (13) is mounted on or within a transverse yoke (7) which connects said columns (3,4) and said traction means (**10*a*,10*b*) are enclosed within said columns (3,4**).

5. A lifting platform according to claim 4 wherein said drive means (13) is a hydraulic cylinder-piston combination.

6. A lifting platform according to claim 1 wherein said lifting elements (8,9) extend such that they are movable within said columns (3,4) and said traction means (**10*a*,10*b*) extend partially inside said lifting elements (8,9**).

7. A lifting platform for a motor vehicle comprising at least two vertically movable columns (3,4) having at least one supporting area (5,6) for receiving the wheels of the vehicle, wherein lifting elements (8,9) are disposed on each respective column (3,4) and are movable within said columns (3,4), characterized in that the lifting elements (8,9) have a common drive means (13) connected thereto via traction means (**10*a*,10*b*), said drive means (13) being mounted on or within a transverse yoke (7) which connects and is carried with said columns (3,4**).

8. A lifting platform according to claim 7 wherein said drive means (13) acts in substantially the horizontal direction and said traction means (**10*a*,10*b*) are operatively connected to the lifting elements (8,9) through guide rollers (11,12*a*,12*b***).

9. A lifting platform according to claim 8 wherein said drive means (13) acts only on one side thereof and said traction means (**10*b*) connected to one of said lifting elements (9) undergoes a 180° deflection through a guide roller (15**).

10. A lifting platform according to claim 7 wherein said traction means (**10*a*,10*b*) are enclosed within said columns (3,4**).

11. A lifting platform according to claim 7 wherein said drive means (13) is a hydraulic cylinder-piston combination.

12. A lifting platform according to claim 7 wherein said lifting elements (8,9) extend such that they are movable within said columns (3,4) and said traction means (**10*a*,10*b*) extend partially inside said lifting elements (8,9**).

* * * * *